United States Patent [19]

Söderberg

[11] 4,119,269

[45] Oct. 10, 1978

[54] SERVICE BOX

[75] Inventor: Bo Söderberg, Stockholm, Sweden

[73] Assignee: AB Värdeskydd, Gavle, Sweden

[21] Appl. No.: 791,884

[22] Filed: Apr. 28, 1977

[30] Foreign Application Priority Data

Apr. 29, 1976 [SE] Sweden ..... 7604939
Mar. 30, 1977 [SE] Sweden ..... 7703718

[51] Int. Cl.[2] ..... B65D 91/00
[52] U.S. Cl. ..... 232/43.3; 109/66
[58] Field of Search ..... 109/24.1, 66; 232/43.3, 232/44, 43.1

[56] References Cited

U.S. PATENT DOCUMENTS

| | | | |
|---|---|---|---|
| 2,562,632 | 7/1951 | Mosman | 109/66 |
| 2,792,171 | 5/1957 | Rosset | 232/44 X |
| 3,615,050 | 10/1971 | Deaton et al. | 232/43.3 |

*Primary Examiner*—Mervin Stein
*Assistant Examiner*—David H. Corbin
*Attorney, Agent, or Firm*—Strauch, Nolan, Neale, Nies & Kurz

[57] ABSTRACT

A service box for deposit of valuables for a subsequent feed down through a delivery aperture to a vault or safe chamber. The service box has an insert aperture with a lockable insert aperture closure. The service box below the insert aperture has a fixed base projecting approximately halfway to the back wall and providing the delivery aperture and includes an inner box formed by a roof, side walls and back wall, with open front and open base. The inner box is mechanically reciprocable and a scraper, fixed on a side of the inner box near its open end, reciprocates with the inner box back along the service box fixed base. A sliding hatch which slides horizontally is located below the service box fixed base for closing and opening the delivery aperture, being connected to the inner box by linkage so movement of the sliding hatch and of the inner box is in opposite directions. An electric motor is used to reciprocate the inner box and the sliding hatch. A second embodiment includes a reciprocable front closure for the inner box.

13 Claims, 12 Drawing Figures

SERVICE BOX

This invention refers to a service box, which is intended for use in banks, post offices and other establishments which safekeep valuables, so that documents, securities, money etc can be deposited with the bank, post office, establishment etc in question even when the bank, post office, establishment etc in question is closed to the public.

There are service boxes which have inside a lockable insert hatch not only an existing shaft or channel leading down to a vault, safe or similar, but also have mounted immediately inside the insert hatch a rolling or rotating cylinder which is partly intended to seal off a direct connection between the insert aperture and the shaft or channel and partly intended to receive the material to be deposited, and, after the insert hatch has closed and the cylinder has rolled or rotated more or less than one revolution, to deliver the inserted material to the shaft or channel. The design is fairly complicated, and it is difficult to ensure by means of simple units, feed-out of all material inserted in the cylinder. The invention presented here is intended to provide a service box which is simple in its manufacture, which ensures reliable feed down to a vault, safe, etc., material inserted through the service box insert aperture, and which also ensures that deposited material is rendered inaccessible to unauthorized persons by means of the lockable insert aperture hatch.

This is achieved by a service box with a front wall, side walls and back wall and with an insert aperture in the front wall and which is provided with a lockable insert hatch in accordance with the invention is characterized by the fact that in the service box below the insert aperture a fixed base reaches from the front wall to approximately halfway to the back wall, so that between this and the fixed base a delivery aperture is formed, and that an inner box, which is formed by a roof, side walls and back wall, is provided immediately above and opening onto the fixed base in such a way as to be mechanically movable, and that a scraper is fitted on the side of the inner box adjacent its end which is opposite the back wall between the side walls of the box for interaction with the fixed base, and that a sliding hatch which slides horizontally is fitted immediately below the fixed base for the purpose of, depending on its position, closing or opening the delivery aperture, and is so connected to the inner that movement of the sliding hatch and of the inner is in opposite directions.

The invention is clarified by a somewhat schematic operative form shown on the appended drawings as an example.

Figure 1:
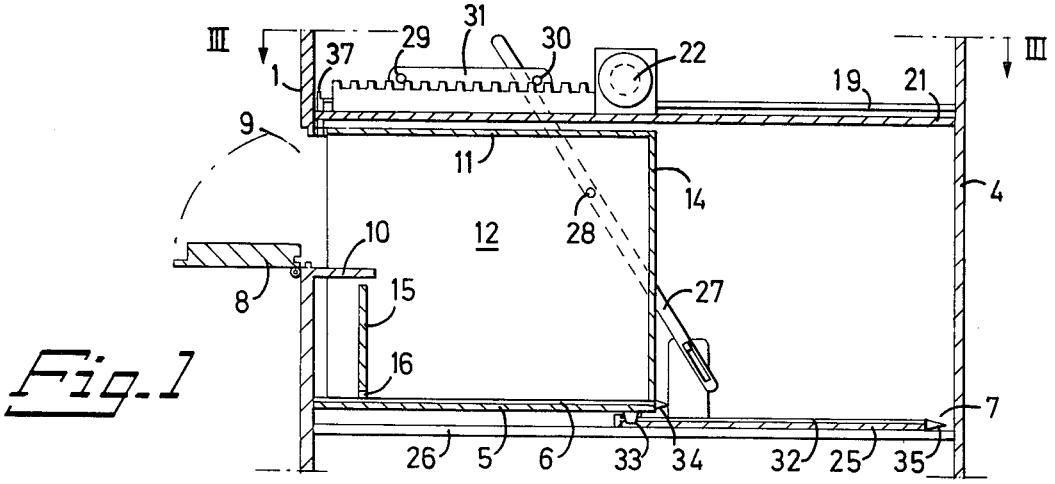
FIG. 1 shows a vertical cross-section of the service box in accordance with the invention, as viewed along line 1—1 in FIG. 3.

As viewed in FIGS. 1–7, the service box has a front wall 1, side walls 2, 3, a back wall 4, and a fixed base 5, the upper side of which has grooves 6 parallel to the side walls 2, 3, and which base 5 reaches from the front wall 1 only about halfway to the back wall 4, so that a delivery aperture 7 leading to a shaft, vault or deposit vault located thereunder is formed. The service box is intended to be mounted in the usual way entirely in a wall or similar in a building and this may be achieved in various ways and therefore the wall sections surrounding the entire service box are not shown in the figures, except those on the front side. In the front wall 1 is an insert hatch 8, which is lockable, advisably with a key, and which is positioned in an insert aperture 9, along the lower edge of which is a horizontal screen 10. Below the insert aperture 9 is a box, which has a roof 11, side walls 12, 13 and a back wall 14 but no bottom. On the opposite side to the back wall 14 of the box is a scraper 15 which is mounted between the side walls 12, 13 at such a height that its upper edge is on a negligibly lower level than screen 10. In grooves 6 in the base 5 the scraper 15 has extending scraper teeth 16. The box is suspended above the fixed base 5 by means of four suspension brackets 17, which are fitted to the roof of the box 11 and which each carry a ball bearing 18 running on rails 19 fitted to the inside of the side walls 2, 3 of the box. Above the box between the front wall 1 and back wall 4 of the service box is fitted a bridge 21, which carries a reversible electric motor 22 with a gear drive 23 linked to a rack 24 fitted to the box roof 11, whereby the motor 22 can move the box from the position shown in FIG. 1 to the position shown in FIG. 2 and back again to the first position. Immediately below the fixed base 5 is a horizontal sliding hatch 25 fitted so that it can slide along guides or strips 26 on the side walls 2, 3. The sliding hatch 25 has a sufficient area to completely seal the delivery aperture 7. Connected to the sliding hatch 25 by means of a hinged joint is one end of a lever 27 which is journaled on a pin 28 fitted to side wall 2. The other end of lever 27 reaches between a pair of stops 29, 30, which are fitted at a distance apart from each other, in the form of studs in a mounting 31, which is attached to the roof of the box 11, so that when in FIG. 1 the box moves to the right the sliding hatch 25 moves to the left and vice versa. The upper side of the sliding hatch is provided with grooves 32 which extend in sliding direction of the sliding hatch, and the scraper teeth 33 on the underside of the fixed base 5 push into these grroves 32. Along the edge facing the delivery aperture 7 both the fixed base 5 and the sliding hatch 25 are fitted with sawlike teeth 34, 35, which serve as protection against so-called fishing and prevent deposited documents and similar from being fished up.

Figure 5:
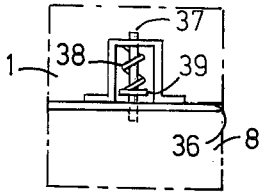
FIGS. 5 and 6 show on a larger scale various side elevations of a locking device and adjacent parts of the service box.
Figure 6:
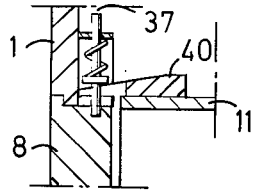

On the inside of the front wall 1 immediately above the insert aperture 9 is a ledge or support strip 36, which carries a locking device, which, as is most clearly shown in FIGS. 5 and 6, comprises a vertically movable locking pin 37, the lower end of which is devised to lock into insert hatch 8 by means of the action of a spring 38, which presses against the upper side on a flange 39, which is so positioned on the locking pin that there is always a little play between the flange 39 and the support strip 36 when the locking pin is locked with the insert hatch. On the box roof 11 is mounted a lifting device 40, which is wedge-shaped when viewed from the side and fork-shaped when viewed from above, and which, when the box is moved forward to the front wall 1, moves in under the flange 39 and lifts the locking pin 37 out of its engagement with the insert hatch 8.

Figure 7:
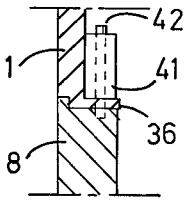
FIG. 7 shows, also on a larger scale, an additional locking device and adjacent part of the service box.
Figure 8:
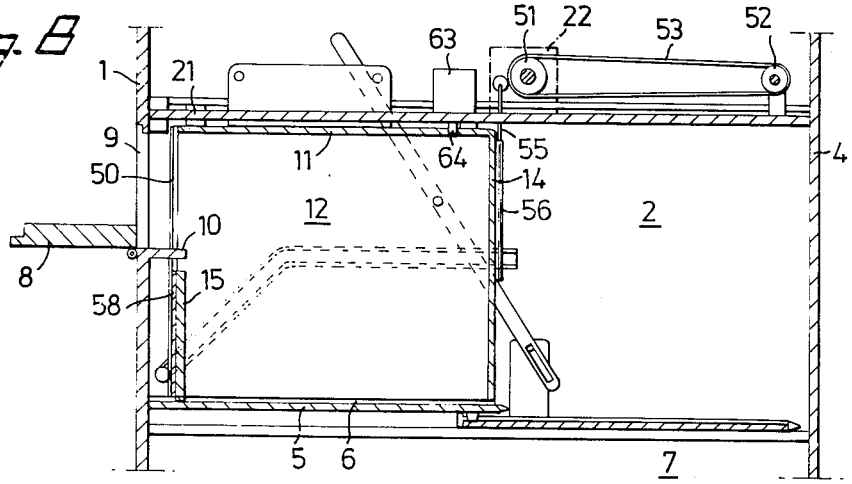
FIGS. 8 and 9 show a vertical cross-section of the service box in accordance with the invention.
Figure 9:
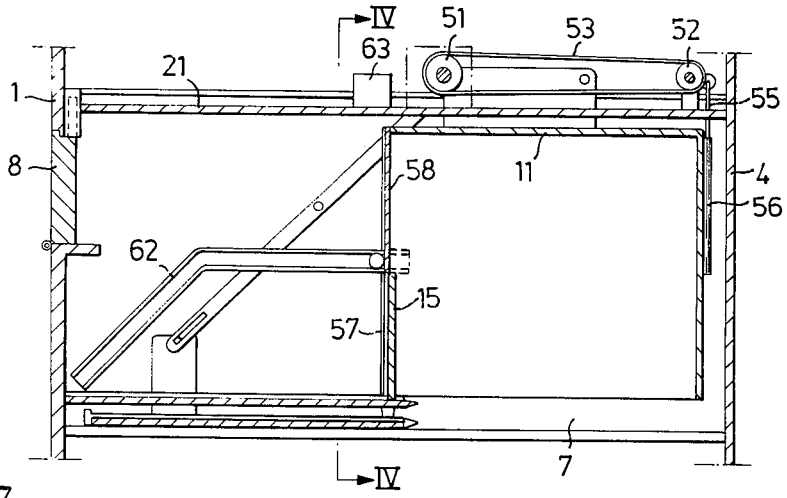
Figure 10:
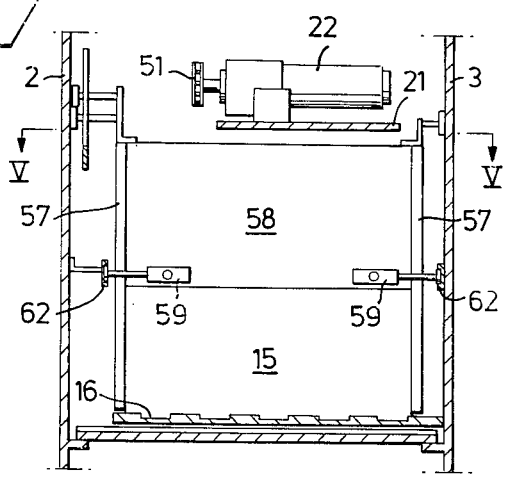
FIG. 10 shows a vertical cross-section along line IV—IV in FIG. 9.
Figure 11:
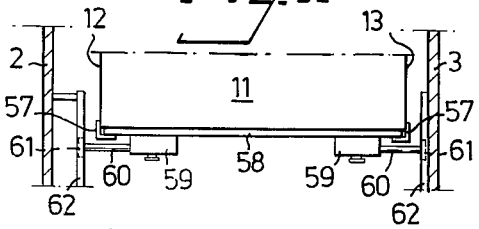
FIG. 11 shows a horizontal cross-section along line V—V in FIG. 10.
Figure 12:
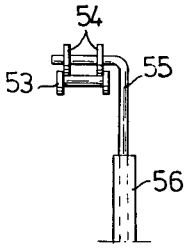
FIG. 12 shows on a somewhat larger scale a detailed device.

The said ledge or support strip 36 supports a further locking device, FIG. 7, in the form of a solenoid 41 with a spring-operated vertical iron core which serves as a locking pin 42 and which locks into the insert hatch 8 when the solenoid is live but which is kept disengaged by the spring when the solenoid is not live.

The described service box in accordance with the invention is used and functions as described in the following, in which context it is assumed that the box 11–14 is positioned immediately inside the insert aperture 9 and the sliding hatch 25 is covering the delivery aperture 7, as shown in FIG. 1. To insert documents or other material, the insert hatch 8 is opened with a key and the documents etc are laid on the fixed base 5. When the insert hatch 8 is then closed, a limit position switch, which is not shown, is activated and the motor 22 starts and begins to move the box to the right, whereby the scraper 15 particularly by means of its scraper teeth 16 in grooves 6 pushes in front of it the documents etc laid on the fixed base 5. At the same time as current is fed to the motor 22, current is fed to the solenoid 41 and the locking pin 42 is immediately moved to lock into the insert hatch 8. During the movement of the box the wedge-shaped lifting device 40 is pulled out of engagement with the flange 39 so that also the locking pin 37, operated by the spring, engages with the insert hatch 8. A short period of time passes before the wedge-shaped lifting device 40 has had time to withdraw enough for the locking pin 37 to engage with the insert hatch, but during the said period of time the locking pin 42 is already locked into the insert hatch and prevents also during the said period of time any unauthorized opening of the insert hatch. The motor 22 continues to pull the box in the direction of the delivery aperture 7 and gradually the stop 29 moves against the lever 27, which swings and pulls the sliding hatch away from the delivery aperture 7. If, when the box is positioned partly above the delivery aperture and the sliding hatch 25, any document etc should fall down onto the sliding hatch, it will in due course be scraped off by the scraper teeth 33. When the box reaches its rearmost position above the delivery aperture 7, it moves against a limit position switch, which is not shown, so that the drive direction of the motor 22 is reversed and the box is moved back to its initial position above the fixed base 5, whereby the lifting device 40 lifts the locking pin 37 out of its engagement with the insert hatch and the box moves against a limit position switch, which is not shown, whereby the current to the motor 22 and to the solenoid 41 is cut off, with the result that the locking pin 42, operated by the spring, is lifted out of its engagement with the insert hatch 8, which can now be opened with a key to permit the insertion of documents etc for forwarding to the delivery aperture 7 and the vault, safe, deposit box etc located under the delivery aperture.

The service box as specified in the invention has the advantage that as soon as documents etc., have been put into the service box on the fixed base 5 and the insert hatch 8 has been closed, the box pulls the documents etc to the delivery aperture 7, which opens by the sliding hatch 25 moving away, and delivers the documents etc into the delivery aperture. The scraper teeth 16 and 33 ensure that documents etc are effectively scraped off and that they cannot be left lying on the fixed base 5 or the sliding hatch 25. When the box is moved away from the delivery aperture 7, the sliding hatch 25 seals this aperture. This and the sawlike teeth 34, 35 on the fixed base 5 and the sliding hatch 25 respectively form an effective protection against access to the documents etc through the service box during feed to or feed down through the delivery aperture. In addition the service box is simple in its manufacture and movement of components in the service box is simple.

The service box described in FIGS. 8–12 is on the whole of the same design as in FIGS. 1–7 and therefore in the following it is primarily only the design which differs from the previously mentioned design which is described, and parts common to both designs have the same designations.

Thus in the front wall 1 is positioned the insert hatch 8, advisably lockable by means of a key, the locking device of which hatch can be time-set to permit locking of the hatch at any determined time of day whatsoever. Inside the insert aperture 9 is the box, which has a roof 11, side walls 12, 13 and a back wall 14 but has no bottom. On the side opposite the back wall 14 of the box is a scraper 15, mounted between the side walls 12, 13, so that it forms a low front wall in the box and above this is the aperture 50.

Above the box is mounted a bridge 21 which carries an electric motor 22 with a sprocket 51, and around sprocket 51 and an additional sprocket 52, which is supported by bridge 21, runs a continuous chain 53. On the chain, FIG. 5, is attached a bearing lug 54 and in this is journaled the bent end of a rod 55, which can be pushed into a sleeve 56 mounted on the back wall 14 of the box.

Figure 2:
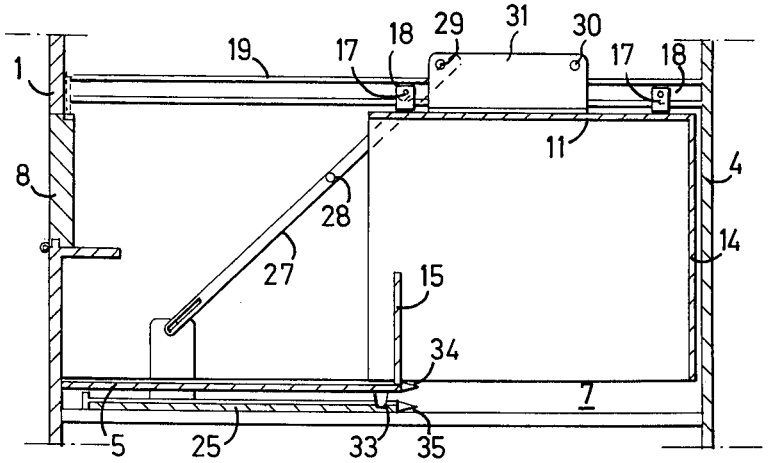
FIG. 2 shows a vertical cross-section as viewed along line 11—11 in FIG. 3 but with certain parts in different positions than in FIG. 3.
Figure 3:
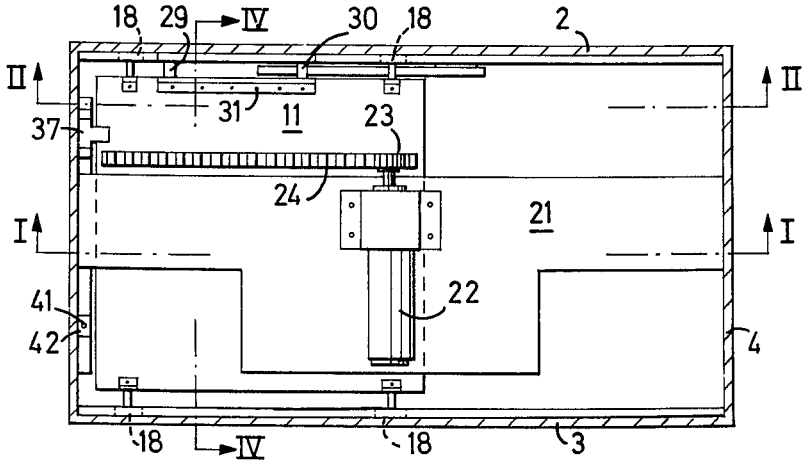
FIG. 3 shows a horizontal cross-section along line 111—111 in FIG. 1.
Figure 4:
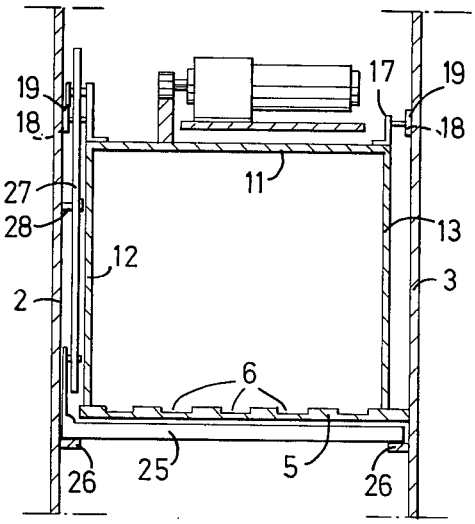
FIG. 4 shows a vertical cross-section along line IV—IV in FIG. 3.

At each of the vertical corners of the front side of the box and along their entire length is mounted a guide 57, FIG. 4, and a box hatch 58, made of steel or similar material, is mounted so that it can slide along the guides 57. On the box hatch 58 are mounted two holders 59 with journals 60, which are axially adjustable in the holders and which have on their outer end a roller 61 positioned in guide tracks 62, which are attached to side walls 2 and 3 respectively and which extend longitudinally as shown in FIGS. 1 and 2. The axial height of the box hatch is sufficient for the box hatch in its upper position, FIGS. 2 and 3, to cover the existing aperture 50 above the scraper-front wall 15. On the upper edge of the box hatch may be constructed or fitted a device which cuts or shears electrical leads connected to an explosive charge which may have been placed in the box.

On the bridge 21 is also an electro-magnet 63 with a lock cylinder 64, which locks into the roof 11 of the box when the box is in its forward position.

To the motor 22 are advisably connected two limit position switches, which are not shown, and one of which is activated when the insert hatch 8 is closed so that the motor 22 starts, and the other of which is activated by the box, when the box reaches the insert aperture 9, so that the motor stops. In addition a switch, which is not shown and which is time-adjustable, e.g. between 1 and 30 min., can be activated by the box, when the box has moved, for example, halfway from the insert aperture and can cause the motor 22 to stop for the period of time regulated by the switch. The advantages and method of functioning of the described service box are as follows. When the service box's movable box is positioned adjacent to the insert aperture 9, the box hatch 58 under the control of the guides 57 and guide tracks 62 has been moved down in front of the front wall 15 and documents, money etc can be placed in the box. When the insert hatch 8 is then closed, the electro-magnet 63 disengages the lock cylinder 64 and the appropriate limit position switch is activated, so that the motor starts and the box begins to move away from the insert aperture, and at the same time the box hatch 58 begins to seal the box aperture 50, so that the contents of the box become more difficult for unauthorized persons to reach. If an explosive charge has been placed in the box, the blasting cable connected to the said charge can be cut off by the upper edge of the box, particularly if this has been fitted with a cutting device. When the box has moved approximately halfway along its path from the insert aperture it can remain stationary, for example for 15 minutes, by virtue of the fact that the box has activated the adjustable time switch. This will prevent a possible explosive charge from exploding straight down through the delivery aperture 7 and down into the shaft or similar. The application of the continuous chain 53 in the drive unit makes this an extremely simple way of providing the box with a forward and return movement.

The invention will not be considered to be limited solely to the design which is described above and which is illustrated in the drawings, since this design can be modified, particularly with regard to the design of components. For example, the unit for the counter-movement of the box and the sliding hatch can be modified, the supporting units for the box and the sliding hatch can be designed in varying ways, the construction of the transmission between the box and the motor can be varied in a more effective way as can motor type and regulating units for providing the box with forward and return movement, and the grooves and the scraper teeth interacting with the grooves can be replaced by other units designed for the same purpose.

What I claim is:

1. A service box having outer and inner boxes which are relatively reciprocable, the outer box having a front wall, side walls, and a back wall, said front wall including an insert aperture and a lockable insert aperture hatch, characterized by the fact that: the outer box, below the insert aperture, has a fixed base extending from the front wall to about halfway to the back wall to provide, between the back wall and the fixed base, a delivery aperture; the inner box having an open bottom and comprising side walls, and a back wall; drive means including cooperating means on the outer portion of the inner box and on the inner portion of said outer box enabling forward and backward reciprocation of said inner box between a forward position over said fixed base and a rearward position over said delivery aperture; a scraper means mounted on a side wall of the inner box adjacent the lower portion of its front end and extended between the side walls of the inner box for the purpose of interacting closely adjacent the fixed base; a sliding hatch; means which mount said sliding hatch for horizontal sliding movement on the outer box immediately below the fixed base to enable closing and opening the delivery aperture; and mechanical link means interconnect said inner box and said sliding hatch so that the hatch and said inner box move in opposite forward and backward directions, whereby the hatch closes the delivery aperture when the inner box is at the front portion of the outer box and opens the delivery aperture.

2. A service box as defined in claim 1 wherein the interconnecting mechanical link means comprises a lever member pivoted intermediate its ends on a side wall of said outer box and having one end connected to said sliding hatch and means on the inner box adapted to engage and swing the other end of said lever member as said inner box moves back and forth.

3. A service box as defined in claim 2, characterized by the fact that the inner box is provided with stops which are positioned in fore and aft spaced apart disposition for the purpose of alternate interaction with said other end of said lever member, and said one end of said lever member is connected by a hinge means to the sliding hatch.

4. A service box as defined in claim 1, characterized in that both the fixed base and the sliding hatch, on their upper surfaces, are provided with grooves which run in the fore and aft direction and said scraper means includes formations which are complementary to and extend down into said grooves.

5. A service box as defined in claim 1 characterized by the fact that both the fixed base and the sliding hatch, on the edges facing the delivery aperture, are fitted with sawlike teeth.

6. A service box as defined in claim 1, characterized by the fact that inside its front wall, immediately above the insert aperture, is a locking device equipped with a vertical locking pin having a flange and a spring which biases the locking pin to engage with the insert aperture hatch in its closed position, and that the said inner box on its upper part is equipped with a wedge-shaped lifting device, which is adapted to move under the locking pin flange and lift the locking pin out of engagement with the insert aperture hatch, when the inner box is moved to its front position.

7. A service box as defined in claim 1 or 6, wherein the drive means is an electric motor and, inside its front wall immediately above the insert aperture, is a locking device in the form of a solenoid with a spring biased vertical iron core, said core serving as a locking pin which is spring-biased in a direction to urge the locking pin engaged with the insert aperture hatch when it is in the closed position, and that said locking pin can be shifted out of engagement with the insert hatch by means of energization of the solenoid when it and the electric motor are supplied with current when the insert aperture hatch is closed.

8. A service box as defined in claim 1, characterized by the fact that: the inner box has a roof; a bridge is fixed on the outer box above the inner box between the front wall and the back wall of the outer box; and said drive means includes a reversible electric motor mounted on said bridge and a gear and rack drive which interconnect said motor and the roof of the inner box for the purpose of moving the inner box forwards and backwards.

9. A service box as defined in claim 1, characterized by the fact that the inner box at its front end is fitted with a front end hatch mounted for vertical movement on said inner box; and means which couple said front end hatch to said outer box and actuated by movement of the inner box for opening and closing of the front end of said inner box.

10. A service box as defined in claim 9, characterized by the fact that the inner box front end hatch is guided on vertical guides secured on the front end of the inner box and include a pair of laterally protruding journals, each having a roller engaged with and controlled by said guide tracks which extend along the side walls so that the inner box front end hatch, during movement of the box, is moved between an open and closed position.

11. A service box as defined in claim 9, characterized by the fact that the upper edge of said box front end hatch is fitted with a cutting means, the purpose of which is for cutting a cable or similar object, improperly inserted to extend into the box, when the box hatch is moved to its closed position.

12. A service box as defined in claim 9, characterized by the fact that a lock cylinder with an electro-magnet operator is provided to engage with the inner box when the inner box is adjacent to the insert aperture.

13. A service box as defined in claim 1, characterized by the fact that said drive means is an electric motor with a continuous chain driven by said motor, both said motor and said chain being mounted on said outer box above said inner box; connecting units interconnect said inner box with said continuous chain so that rotation of said electric motor in one direction provides continuous movement of the inner box from adjacent the insert aperture to adjacent the delivery aperture and back again to adjacent the insert aperture; and means to interrupt said continuous movement when said inner box has moved a short distance away from the insert aperture comprising a time-regulated switch activated by a predetermined movement of said inner box which provides a temporary interruption of the operation of the electric motor.

* * * * *

UNITED STATES PATENT AND TRADEMARK OFFICE

CERTIFICATE OF CORRECTION

PATENT NO. : 4,119,269

DATED : October 10, 1978

INVENTOR(S) : Bo Soderberg, Sweden

It is certified that error appears in the above-identified patent and that said Letters Patent are hereby corrected as shown below:

Column 1, line 49, after "inner" insert --box--.

, line 50, after "inner" insert --box--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*